US009617688B2

(12) United States Patent
Ellis

(10) Patent No.: US 9,617,688 B2
(45) Date of Patent: Apr. 11, 2017

(54) RAIL ASSEMBLY

(71) Applicant: Polycorp Ltd., Elora (CA)

(72) Inventor: Richard Theodore Ellis, Kitchener (CA)

(73) Assignee: POLYCORP LTD., Elora (CA)

( * ) Notice: Subject to any disclaimer, the term of this patent is extended or adjusted under 35 U.S.C. 154(b) by 59 days.

(21) Appl. No.: 14/315,705

(22) Filed: Jun. 26, 2014

(65) Prior Publication Data

US 2015/0376842 A1 Dec. 31, 2015

(51) Int. Cl.

| | |
|---|---|
| ***E01B 5/08*** | (2006.01) |
| ***E01B 19/00*** | (2006.01) |
| ***E01B 21/00*** | (2006.01) |
| ***E01B 29/32*** | (2006.01) |

(52) U.S. Cl.

CPC ..... *E01B 5/08* (2013.01); *E01B 19/00* (2013.01); *E01B 21/00* (2013.01); *E01B 29/32* (2013.01)

(58) Field of Classification Search

CPC ... E01B 5/00; E01B 5/02; E01B 19/00; E01B 19/003; E01B 21/00; E01B 21/02

USPC ..... 238/122, 130, 264, 283, 382

See application file for complete search history.

(56) References Cited

U.S. PATENT DOCUMENTS

| | | | |
|---|---|---|---|
| 2,670,136 | A | 2/1954 | Moses |
| 3,344,990 | A | 10/1967 | Bingmann et al. |
| 3,525,472 | A | 8/1970 | Sato |
| 3,755,670 | A | 8/1973 | Damy |
| 3,837,948 | A | 9/1974 | Nelson et al. |
| 4,239,156 | A | 12/1980 | Skinner et al. |
| 4,365,743 | A | 12/1982 | Trickel et al. |
| 4,386,736 | A | 6/1983 | Benkler et al. |
| 5,160,084 | A | 11/1992 | Owen et al. |
| 5,503,331 | A | 4/1996 | Uramson, Jr. et al. |
| 5,609,294 | A | 3/1997 | Lucas, Jr. |
| 5,622,312 | A | 4/1997 | Martin |

(Continued)

FOREIGN PATENT DOCUMENTS

| | | | | |
|---|---|---|---|---|
| EP | 0364756 A2 | | 4/1990 | |
| EP | 2019168 | * | 6/2008 | ..... E01B 19/00 |

(Continued)

OTHER PUBLICATIONS

Machine-generated English Translation of EP 2 019 168 A1.

(Continued)

*Primary Examiner* — R. J. McCarry, Jr.

(74) *Attorney, Agent, or Firm* — Carlson, Gaskey & Olds P.C.

(57) ABSTRACT

A rail assembly including one or more rail bodies formed for supporting rolling engagement of a train wheel thereover, the rolling engagement generating vibrations in the rail body. The rail assembly includes one or more boots formed for attachment to the rail body to substantially electrically isolate the rail body relative to ground material. The boot includes a chamber wall for at least partially defining a chamber between the rail body and the chamber wall when the boot is attached to the rail body. The rail assembly also includes one or more inserts positionable in the chamber, at least a part of the vibrations being transmittable to the insert when the insert is positioned in the chamber, for dissipation of at least a proportion of the part of the vibrations in the insert.

9 Claims, 9 Drawing Sheets

(56) References Cited

U.S. PATENT DOCUMENTS

| | | | |
|---|---|---|---|
| 6,129,288 | A | 10/2000 | Petersen et al. |
| 6,230,981 | B1 | 5/2001 | Hill et al. |
| 6,283,383 | B1 | 9/2001 | Blank et al. |
| 6,296,195 | B1 | 10/2001 | Blank et al. |
| 6,402,044 | B1 | 6/2002 | Sato |
| 6,471,138 | B1 | 10/2002 | Blank et al. |
| 6,726,116 | B2 | 4/2004 | Hofstetter, Sr. |
| 7,484,669 | B2 | 2/2009 | Gray, Jr. |
| 7,556,209 | B2 | 7/2009 | Sears |
| 8,172,158 | B1 | 5/2012 | Burkhardt et al. |
| 8,714,462 | B1 | 5/2014 | Bedford et al. |
| 2005/0023366 | A1 | 2/2005 | Williams et al. |
| 2011/0084175 | A1 | 4/2011 | Naquin |
| 2012/0104110 | A1* | 5/2012 | Roberts, Jr. ..... B29C 49/4273 238/84 |

FOREIGN PATENT DOCUMENTS

| | | | |
|---|---|---|---|
| EP | 2019168 | A1 | 1/2009 |
| WO | WO9953141 | | 10/1999 |
| WO | 2004/033795 | A1 | 4/2004 |

OTHER PUBLICATIONS

International Search Report dated Oct. 23, 2015 for European Patent Application No. 15173633.7-1604, filed on Jun. 24, 2015.
Rail Comfort System brochure, Datwyler.

* cited by examiner

RAIL ASSEMBLY

FIELD OF THE INVENTION

The present invention is a rail assembly including one or more rail bodies, one or more boots for positioning on the rail bodies, and one or more inserts to be positioned between the boot and the rail body, for attenuating vibrations.

BACKGROUND OF THE INVENTION

In conventional rail arrangements, a rail may be partially covered with a jacket or "boot" made of rubber. In many cases, the jacket has two purposes: first, it is intended to electrically isolate the rail relative to the ground material in the vicinity, and second, it is intended to mitigate transmission of vibrations from the rail to the ground material.

As is well known in the art, when a train wheel rolls over the rail, the train wheel causes the rail to vibrate. Typically, the vibrations are transmitted through the rail, and generally (but not entirely) propagated or transmitted through the jacket or boot to the ground material. In the prior art, such vibrations (or portions thereof, as the case may be) are then transmitted or propagated through the ground material. The vibrations may be significant enough to disturb those located a short distance away from the prior art rail. For example, where a streetcar or LRT travels on a city street, e.g., past a hospital or a school, the vibrations generated by the rolling engagement of the train wheels with the rail may be generally transmitted through the ground material, to potentially disturb people located in the hospital or in the school.

There have been attempts to partially isolate, or attenuate, vibrations by modifying the jacket or boot. However, there are some disadvantages to the conventional jackets or boots. For example, the conventional boots used in North America generally do not attenuate vibrations well, particularly at lower ambient temperatures. This is because the materials that the boots are typically made of are materials that are relatively easily extrudable, but such materials tend to become rigid and brittle in cold weather. It has been found that, in these conditions, the typical boot does not attenuate vibrations well. Also, certain of the conventional boots generally do not, seamlessly and without any interruption or break thereof, isolate the rail from the ground material. Interruptions in the conventional boots undermine their effectiveness. In summary, the conventional boots provide generally inadequate or inconsistent attenuation of vibrations.

SUMMARY OF THE INVENTION

There is a need for a rail system that overcomes or mitigates one or more of the disadvantages or defects of the prior art. Such disadvantages or defects are not necessarily included in those described above.

In its broad aspect, the invention provides a rail assembly including one or more rail bodies formed for supporting rolling engagement of a train wheel thereover, the rolling engagement generating vibrations in the rail body. The rail assembly also includes one or more boots formed for attachment to the rail body to substantially electrically isolate the rail body relative to ground material. The boot includes a chamber wall for at least partially defining a chamber between the rail body and the chamber wall when the boot is attached to the rail body. In addition, the rail assembly includes one or more inserts positionable in the chamber, at least a part of the vibrations being transmittable to the insert when the insert is positioned in the chamber, for dissipation of at least a proportion of the part of the vibrations in the insert.

In another aspect, the invention provides a rail assembly including one or more rail bodies at least partially supportable by ground material, the rail body being formed for supporting rolling engagement of a train wheel thereover, and the rolling engagement generating vibrations in the rail body. The rail assembly also includes one or more boots formed for attachment with the rail body to substantially electrically isolate the rail body relative to the ground material. The boot includes a foot portion at least partially engageable with the rail body when the boot is attached to the rail body. The foot portion includes a chamber wall to at least partially define a chamber between the rail body and the chamber wall. In addition, the rail assembly includes one or more inserts positionable in the chamber. Each insert includes one or more fluids positioned in one or more cavities in the insert, and one or more engagement elements formed for engagement with the rail body for transmission of a part of the vibrations to the fluid, in which at least a proportion of the part of the vibrations are dissipatable.

In yet another of its aspects, the invention provides a rail system including one or more rail assemblies extending along a predetermined path between a first end and a second end thereof. Each rail assembly includes one or more rail bodies. Each rail body is formed for supporting rolling engagement of a train wheel thereover, the rolling engagement generating vibrations in the rail body. The rail system also includes one or more boot assemblies attached to the rail body and extending along the predetermined path, for substantially electrically isolating the rail body relative to ground material. Each boot assembly includes a number of boots attached respectively in series to the rail body (or rail bodies, as the case may be). Each boot includes a foot portion at least partially engaged with the rail body. Each foot portion includes a chamber wall of each boot respectively to at least partially define a chamber between the rail body and the chamber wall, providing a number of respective chambers located along the predetermined path. In addition, the rail system also includes a number of inserts positioned in the respective chambers located along the predetermined path, each insert being engaged with the rail body for transmission to each insert respectively of at least part of the vibrations. Each insert is configured for dissipation of a characteristic proportion of the part of the vibrations transmitted thereto. Each insert is selected for a predetermined location along the predetermined path respectively based on the characteristic proportion of the part of the vibrations dissipatable by each insert respectively.

In another aspect, the invention provides a method of installing a rail assembly in a predetermined location, including providing one or more rail bodies at least partially supportable by ground material, the rail body being formed for supporting rolling engagement of a train wheel thereover, the rolling engagement generating vibrations in the rail body. One or more boots formed for attachment with the rail body are provided. The boot includes a first material formulated for extrusion thereof. The boot includes a foot portion at least partially engageable with the rail body when the boot is attached to the rail body. The foot portion includes a chamber wall to at least partially define a chamber between the rail body and the chamber wall. One or more inserts are provided, including one or more fluids positioned in one or more cavities in the insert. Each insert includes one or more engagement elements for transmission of a part of the vibrations to the fluid in which at least a proportion of the part of the vibrations are dissipatable. The engagement element includes a second material formulated for at least partial dissipation of the proportion of the part of the vibrations therein. The insert is positioned on the chamber wall. The boot is attached to the rail body, to engage the foot portion of the boot with the rail body and to secure the engagement element to the rail body, for transmission of the part of the vibrations to the fluid. The rail body is positioned, with the boot attached thereto and the insert in the chamber thereof, on the ground material in the predetermined location.

In another of its aspects, the invention provides a method of at least partially attenuating transmission of vibrations of at least one rail body to ground material at least partially supporting said at least one rail body. The method includes providing at least one rail assembly extending along a predetermined path between first and second ends thereof including one or more rail bodies. Also, one or more boot assemblies is provided for attachment to the rail body, the boot assembly including a number of boots for attachment to the rail body. Each boot includes a chamber wall for at least partially defining a chamber between the chamber wall and the rail body, when each boot is attached respectively to the rail body. A number of inserts are provided, to be positioned respectively on the chamber walls. The inserts are positioned onto the chamber walls respectively. The boots are attached respectively in series to the rail body to form the boot assembly and to engage at least part of each insert with the rail body, to permit transmission of at least a part of the vibrations to each insert respectively, for dissipation in the insert of a proportion of the part of the vibrations transmitted to each insert respectively.

In another aspect, each insert is respectively selected to be positioned in a preselected chamber partially based on a characteristic proportion of the part of the vibrations that is dissipated by each selected insert respectively.

BRIEF DESCRIPTION OF THE DRAWINGS

The invention will be better understood with reference to the drawings, in which.

DETAILED DESCRIPTION

Figure 1:
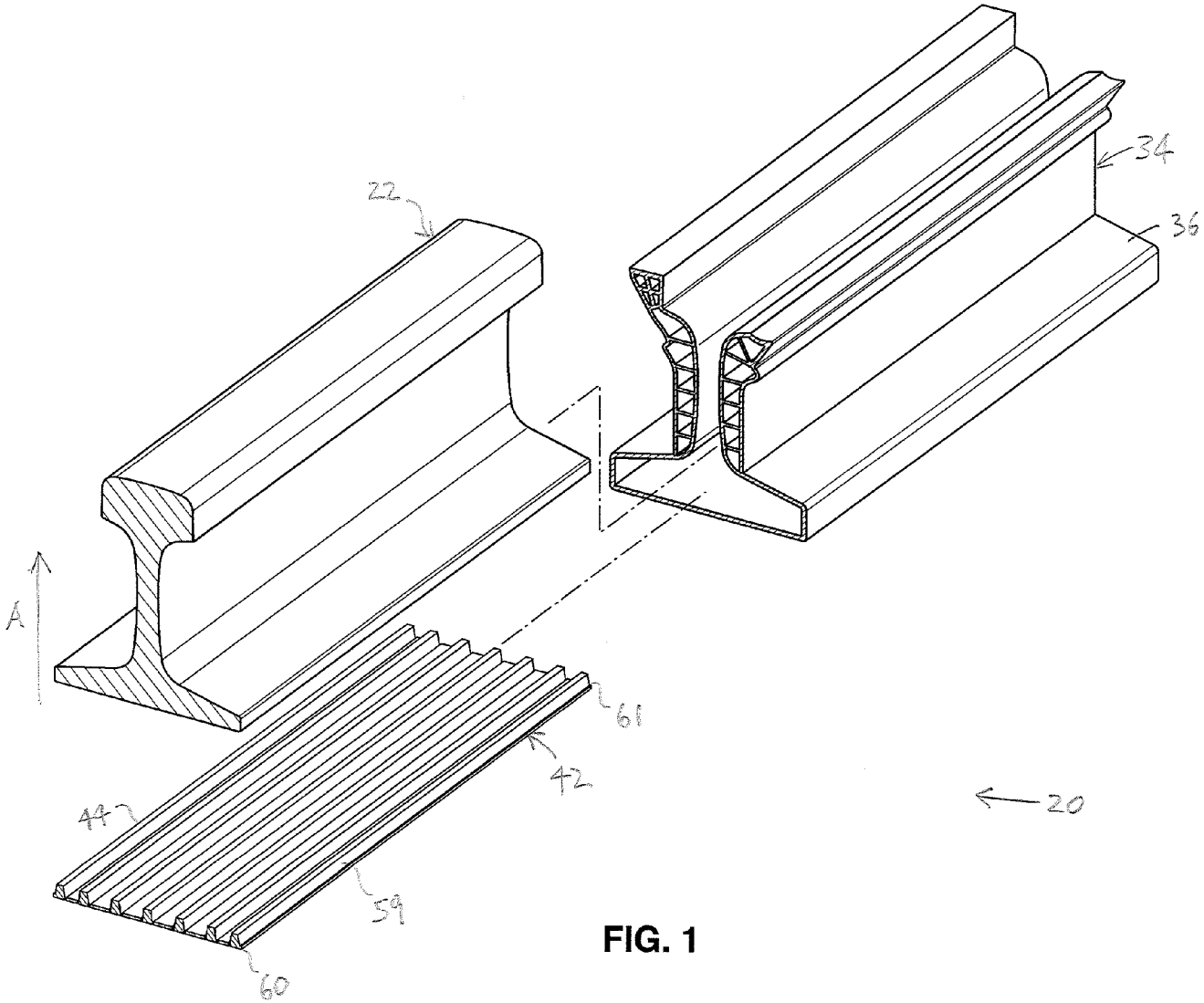
FIG. 1 is an exploded isometric view of an embodiment of a rail assembly of the invention including a rail body, a boot, and an insert.
Figure 2A:
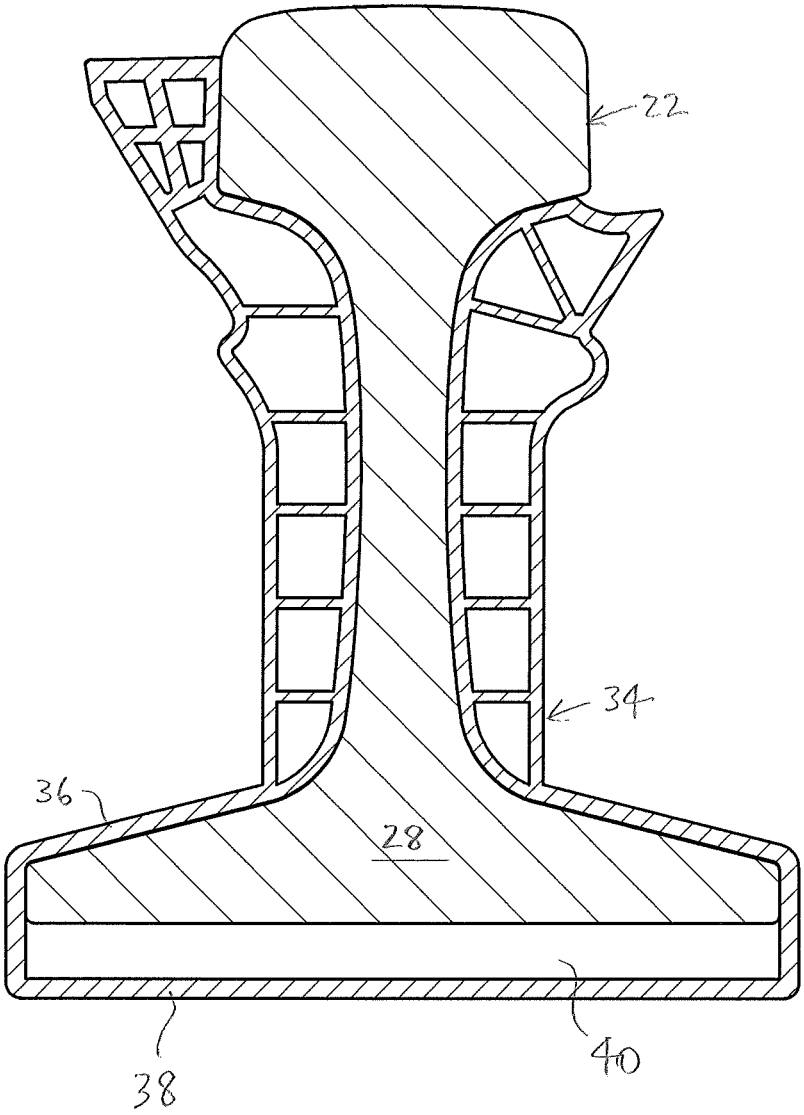
FIG. 2A is a cross-section of the rail body and the boot of FIG. 1, with the boot attached to the rail body.
Figure 2B:
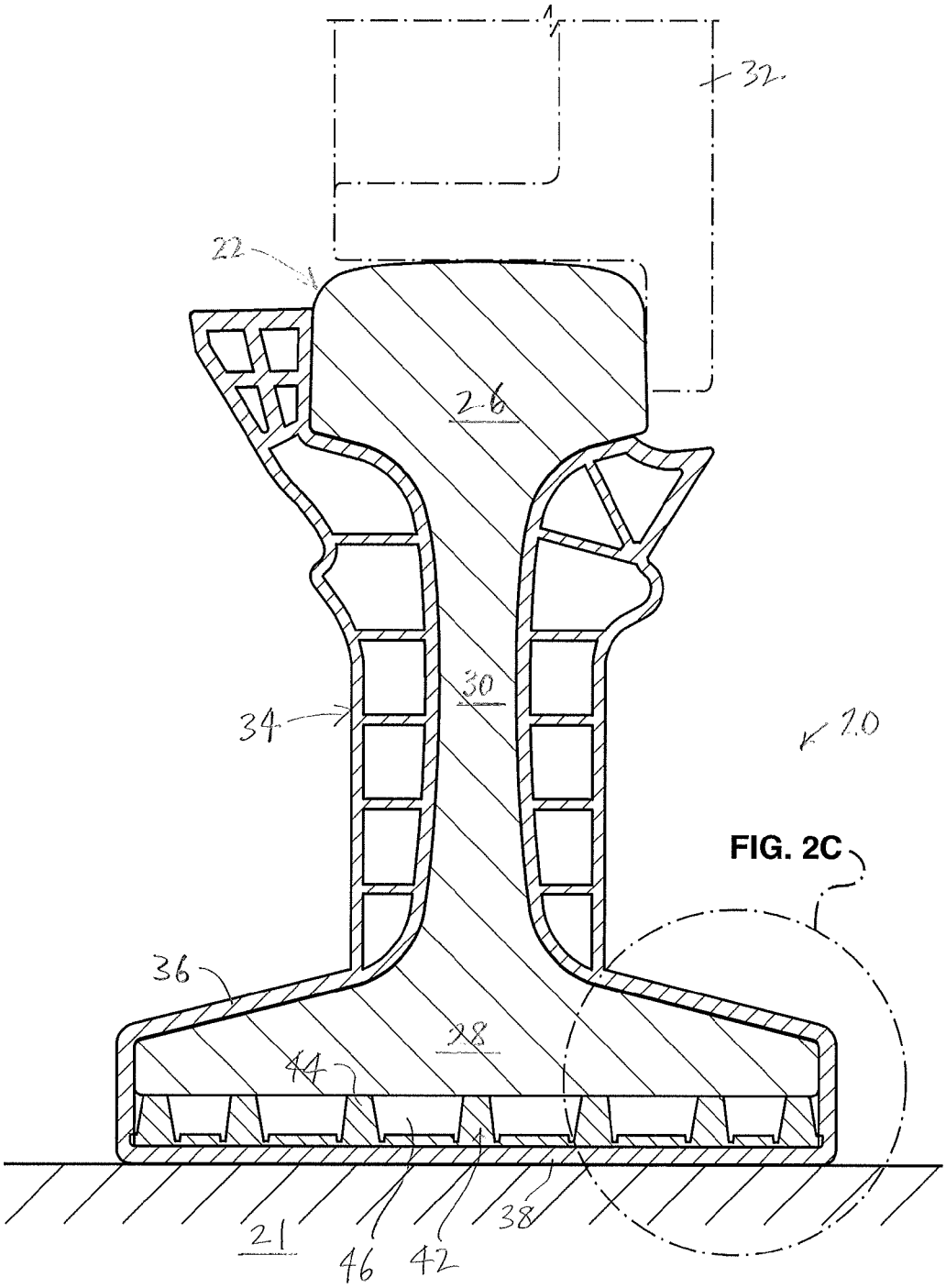
FIG. 2B is a cross-section of the rail assembly of FIG. 1, as assembled, drawn at a larger scale.
Figure 2C:
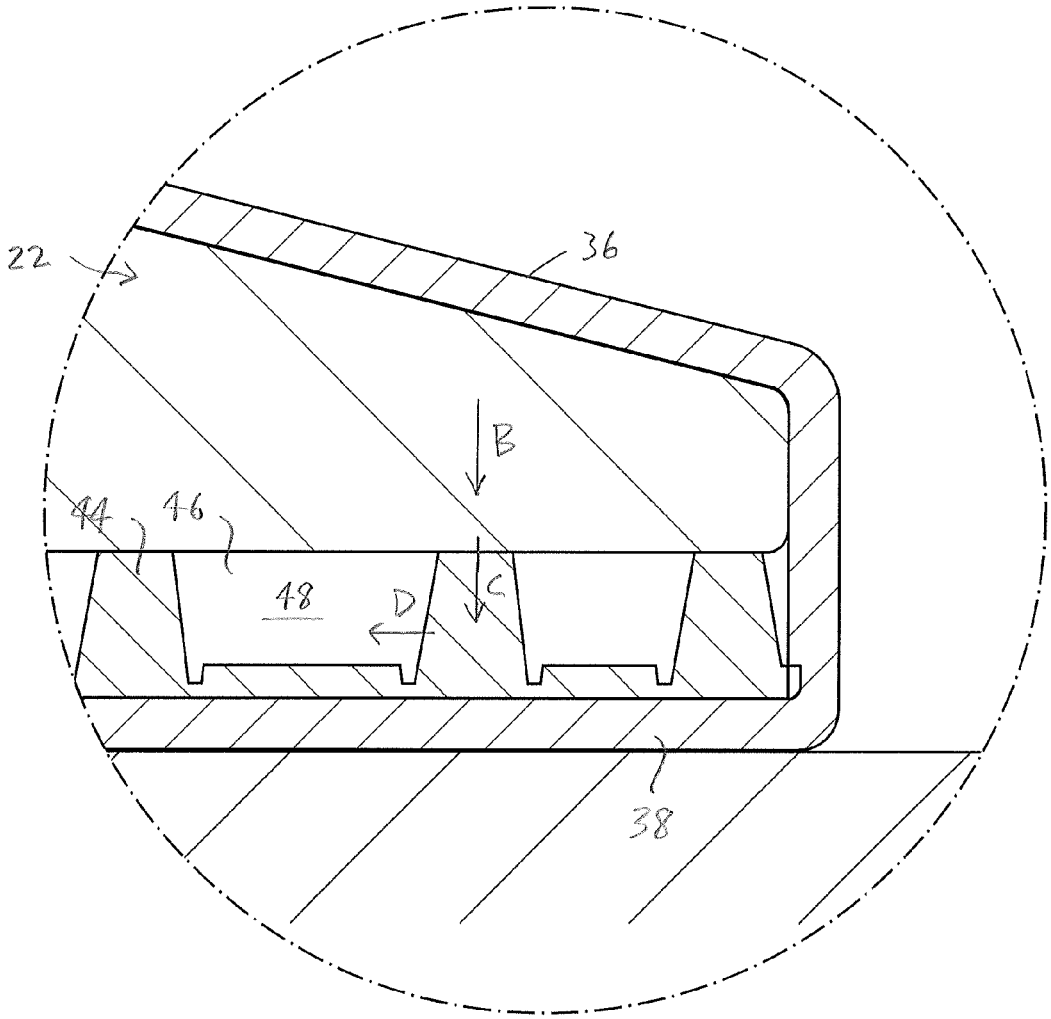
FIG. 2C is a portion of the cross-section of FIG. 2B, drawn at a larger scale.

In the attached drawings, like reference numerals designate corresponding elements throughout. Reference is made to FIGS. 1-2C to describe an embodiment of a rail assembly in accordance with the invention indicated generally by the numeral 20 (FIG. 2B). In one embodiment, the rail assembly 20 preferably includes one or more rail bodies 22. The rail body 22 preferably is formed for supporting rolling engagement of a train wheel 32 thereover, the rolling engagement generating vibrations in the rail body 22. It is also preferred that the rail assembly 20 includes one or more boots 34 formed for attachment to the rail body 22 to substantially electrically isolate the rail body 22 relative to ground material 21. Each boot 34 preferably includes a chamber wall 38 to at least partially define a chamber 40 between the foot 28 and the chamber wall 38 when the boot 34 is attached to the rail body 22 (FIG. 2A). The rail assembly 20 preferably also includes one or more inserts 42 positionable in the chamber 40. At least a part of the vibrations is transmittable to the insert 42 when it is positioned in the chamber 40, for dissipation of at least a proportion of the part of the vibrations in the insert 42.

In one embodiment, the insert 42 preferably includes one or more engagement elements 44 formed for engagement with the rail body 22 when the insert 42 is positioned in the chamber 40, for transmission of the part of the vibrations thereto. As will be described, the boot 34 preferably includes a first material that is formulated for extrusion. It is also preferred that the engagement elements 44 preferably include a second material that is formulated for at least partial dissipation of vibrations transmitted thereto.

It is also preferred that the insert 42 additionally includes one or more cavities 46 having one or more fluids 48 therein engaged with the engagement element 44, for transmission thereto of the proportion of the part of the vibrations and dissipation of the proportion of said part of the vibrations in the fluid 48.

Preferably, the rail body 22 is at least partially supportable by the ground material 21. In another embodiment, the rail assembly 20 of the invention preferably includes the boot 34, formed for attachment to the rail body 22. Preferably, the boot 34 includes a foot portion 36 that is at least partially engageable with the rail body 22, when the boot 34 is attached to the rail body 22. It is also preferred that the chamber wall 38 is included in the foot portion 36. Preferably, the insert 42 includes one or more fluids 48 positioned in the cavities 46 in the insert 42. It is also preferred that the engagement element 44 is engageable with the rail body 22, for transmission of the part of the vibrations to the fluid 48, in which at least the proportion of the part of the vibrations are dissipatable, as will be described. As noted above, in one embodiment, the boot 34 preferably is at least partially made of a first material that is formulated for extrusion, and the engagement elements 44 preferably are at least partially made of a second material that is formulated for at least partial dissipation of vibrations transmitted thereto.

Those skilled in the art would appreciate that the rail body 22 may have any suitable configuration. As an example, in FIG. 2A, the rail body 22 illustrated preferably has a head 26 and a foot 28 connected by a web 30.

As can be seen in FIGS. 1-2C, it is preferred that the boot 34 is engaged with the rail body 22. Those skilled in the art would appreciate that the boot 34 preferably is made of any suitably resilient and flexible material. Preferably, the boot 34 is formed so that it will securely attach to the rail body 22, due to the resilient nature of the material and the shape and size of the boot 34. In particular, the boot 34 preferably is formed to fit securely onto a rail having a particular rail profile. It has been found to be advantageous if the material forming the boot is relatively easily extrudable. For example, thermoplastic vulcanizate may be suitable. This may be advantageous, for example, if the boot 34 is relatively long. For instance, depending on the application, the boot may be approximately 300 feet long. Those skilled in the art would appreciate that the boot may have any suitable length.

The boot 34 may be attached to the rail body 22 by positioning the insert 42 on the chamber wall 38, and opening the boot 34 to the widest extent possible. (It will be understood that the insert may be positioned on the chamber wall 38 before the boot 34 is opened.) The opened boot 34, with the insert 42 located on the chamber wall 38, preferably is moved upwardly (i.e., in the direction indicated by arrow "A" in FIG. 1) until the boot 34 is in position on the rail body 22, and attached to the rail body 22, as illustrated in FIG. 2A. It will be understood that, in one embodiment, the boot 34 preferably is "attached" or positioned on to the rail body 22 by the boot 34 fitting the rail body 22 in a relatively tight friction fit. That is, the boot 34 preferably is held against the rail body 22 or positioned thereon due to the shape and resilience of the boot 34 and friction, as the boot 34 is formed to securely engage the rail body 22. It will be understood that, as the boot 34 is positioned on the rail body 22, the insert 42 is securely engaged with the rail body 22. This engagement takes place because, as the boot 34 is pulled onto the rail body 22, the insert 42 is pushed against the rail body 22 by the chamber wall 38. As will be described further below, it is preferred that the insert 42 remains securely engaged with the rail body 22, in order that part of the vibrations may be transmitted or propagated to the insert 42.

The insert 42 preferably is made of any suitable material, e.g., any suitably resilient and flexible material. In particular, it is preferred that at least the engagement elements 44 are made of any suitable material with good vibration-attenuating characteristics over a wide range of temperatures, e.g., natural rubber. Those skilled in the art would be aware of suitable materials. For instance, instead of natural rubber, a suitable synthetic rubber or polyurethane may be used. It is preferred that the material has excellent vibration attenuation characteristics over a wide range of temperatures that may be encountered in use. The insert 42 preferably is formed so that, when it is in the chamber 40, the insert 42 is securely engaged with the rail body 22. It will be understood that, once the boot 34 is on the rail body 22, the insert 42 preferably is positioned in the chamber 40 so that the engagement elements 44 are securely engaged with the rail body 22.

The insert may have any desired length. Accordingly, unlike the boot, in practice, the insert does not necessarily have to be relatively easily extrudable. This difference is significant because it means that the insert may be made of a variety of materials selected for their flexibility over a wide temperature range, and regardless of their extrudability. However, the material(s) selected to be included in the engagement elements 44 also are required to be sufficiently rigid and strong to support the rail body 22.

For these reasons, it is preferred that the insert is made of natural rubber, or a suitable synthetic rubber or polyurethane. These materials tend to vibrate well, even in cold weather, and they are therefore preferred for use in the insert.

In summary, in one embodiment, the first material preferably is thermoplastic vulcanizate, and the second material is selected from the group consisting of natural rubber, synthetic rubber, and polyurethane. Typically, the thermoplastic vulcanizate has a tensile strength of about 1,150 psi, and a tear strength of about 140 pli (pounds per linear inch). The hardness of the thermoplastic vulcanizate is approximately 73 Shore A.

It will be understood that, in selecting the material out of which the engagement elements 44 of the insert 42 are to be made, a number of competing factors are to be considered. As noted above, the boot 34 preferably is made of a relatively easily extrudable material, e.g., thermoplastic vulcanizate. Those skilled in the art would be aware that the thermoplastic vulcanizate is relatively strong and tough, however, it is not particularly resilient or flexible at lower temperatures, e.g., at about 0° C. or lower. In particular, and as described above, the boot material generally becomes relatively stiff at lower temperatures. As also noted above, the material selected for use in the engagement elements 44 of the insert 42 preferably are adapted to vibrate (i.e., to a limited extent) when the vibrations are transmitted thereto, even in cold weather. However, because the insert 42 is also required to support the rail body 22, the material selected for the engagement elements 44 is also required to be sufficiently rigid that the engagement elements 44 can support the rail body 22 so that the rail body 22 only moves a limited extent vertically, when a train wheel passes thereover.

As noted above, the insert may be made of various materials, or combinations of materials. It is believed that a suitable second material preferably has a tensile strength of approximately 1,500 psi, a tear strength of approximately 150 pli (pounds per linear inch), and a hardness between approximately 60 and approximately 70 Shore A.

Those skilled in the art would appreciate that the tooling that is needed in order to extrude the boot is relatively expensive. As is known, such tooling is used to form the first material into the boot. Because of the relatively high cost of the tooling for the boot, it is preferred that changes in the design of the boot are kept to a minimum.

However, in contrast to the relatively high cost of the tooling for the boot, the tooling for the insert is relatively inexpensive. As a practical matter, this means that the design of the boot preferably is generally unchanged (i.e., unless necessary), but various designs of the insert may be used, depending on the vibration isolation requirements of a particular installation. In short, changes in the insert design are more economically feasible than changes in the boot design.

In an alternative embodiment, the boot and the insert preferably are made of the same material(s). From the foregoing, it can be seen that this may be advantageous where, for instance, it may be acceptable to make the boot and the insert of thermoplastic vulcanizate. For example, where the rail system is to be installed in an area with a relatively warm climate, but the vibration isolation (or vibration attenuation) requirements are relatively low (i.e., a relatively low proportion of the vibrations are required to be dissipated), then the insert and the boot may be made of the same material, i.e., thermoplastic vulcanizate. This may be cost-effective, but as noted above, it is unlikely to be feasible in an installation where temperatures are likely to be below 0° C. for extended periods. However, the insert may have various configurations, depending on the extent to which the vibrations are to be attenuated.

As noted above, the tooling for the boot is much more expensive than the tooling for the insert. Accordingly, even where the insert and the boot are made of the same material (s), it is advantageous to form them separately because, in this embodiment, the insert's design can be changed (to provide different levels of vibration attenuation) at lower cost.

As indicated above, the rail assembly 20 is supportable by the ground material 21. Those skilled in the art would appreciate that the rail assembly 20 may be directly or indirectly supported by the ground material 21. It would also be appreciated by those skilled in the art that the insert 42 and the boot 34 of the invention preferably are installed with, or as part of, "embedded" track, i.e., where the rail body 22, with the boot 34 thereon and the insert 42 in the chamber 40, are substantially surrounded on the bottom and on two sides thereof by concrete or a similar material that supports the rail body 22, with the boot 34 thereon. (Those skilled in the art would appreciate that the upper surfaces of the rail body 22 are exposed.) Those skilled in the art would appreciate that this construction is preferably utilized in an urban environment, because the need to attenuate the vibrations typically arises in connection with track located in an urban setting. In this arrangement, the boot (with the insert therein, attached to the rail body) preferably is installed in its design position before the concrete (i.e., the ground material) that is to surround it on two, or possibly three sides, is poured. The pressure of the freshly poured concrete (i.e., before it has cured and hardened) tends to assist in holding the boot on the rail body shortly after installation. However, the rail assembly 20 may be only indirectly supported by the ground material 21.

For the purposes hereof, a "train wheel" means any wheel on any vehicle that moves over the rail body and is guided by the rail body, e.g., a railway car, a light rail vehicle, a tram car, or a streetcar. It will be understood that the train wheel 32 may have any suitable form, and that the train wheel 32 as illustrated in FIG. 2B, and the rail body 22, are exemplary only. Those skilled in the art would appreciate that the rail body 22 may have any suitable profile, and the train wheel may have any shape suitable for cooperation with the rail body as the train wheel rolls along the rail body.

In FIGS. 2B and 2C, the direction of transmission of the vibrations through the rail body 22 is schematically illustrated by arrow "B". As will be described, the insert 42 is formed to at least partially isolate the ground material 21 from the vibrations produced in the rail body 22 by rolling engagement of the train wheel 32 with the rail body 22. This is achieved by providing the boot 34 and the insert 42 to which part of the vibrations are transmitted, and dissipating at least a proportion of the transmitted part of the vibrations in the insert 42. (Those skilled in the art would appreciate that, in practice, only a part of the vibrations is transmitted or propagated to the insert, and also that, of the part transmitted, only a proportion thereof is dissipated in the insert.) Accordingly, and as can be seen in FIGS. 2B and 2C, it is preferred that the insert 42 is securely engaged with the foot 28, to permit transmission of at least part of the vibrations to the engagement element(s) 44 of the insert 42.

It is believed that, because the engagement element 44 is securely engaged with the foot 28, the part of the vibrations that is transmitted from the foot 28 to the engagement element 44 represents a substantial portion of the vibrations. The propagation of at least the part of the vibrations from the foot 28 to the engagement element 44 is schematically represented by arrow "C" in FIG. 2C.

As described above, in one embodiment, the cavities 46 preferably have one or more fluids 48 positioned therein. For example, in one embodiment, the cavities 46 are filled with air therein, preferably in fluid communication with the atmosphere. For the purposes hereof, it will be understood that references to "a" fluid or "the" fluid will be understood to include references to a mixture of a plurality of fluids (gases), e.g., air. The propagation of part of the vibrations to the fluid(s) 48 is schematically represented by arrow "D" in FIG. 2C.

It will be understood that the directions of the arrows in FIG. 2C are only intended to generally indicate a direction of transmission or propagation in each case. Those skilled in the art would appreciate that the propagation of vibrations in the objects in question would be relatively complex, and it is not necessary to more accurately illustrate such propagation for the purposes hereof.

It is believed that the vibrations are substantially dissipated by the insert, once positioned in the chamber, because the energy of the vibrations is partially dissipated as it travels through the engagement element(s), and also because the remaining energy of the vibration is largely dissipated once the vibration encounters the fluid(s) in the cavities. That is, because the engagement elements 44 preferably are a resilient elastomer (e.g., a suitable rubber), such elements vibrate (i.e., more than the rail body) when the vibrations propagate through them, thereby dissipating some of the energy of the vibrations. Once the part of the vibrations is transmitted to the fluid, such part is propagated through the fluid, and because it is a fluid, at least a substantial segment of the remaining energy of the vibration is dissipated in the fluid.

Accordingly, and as schematically illustrated in FIG. 2C, the proportion of the part of the vibrations preferably are dissipated in the fluid 48. That is, the part of the vibrations is propagated or transmitted to the engagement element 44, and because the fluid 48 is positioned adjacent to and engaged with the engagement element 44, the proportion of the part of the vibrations is also propagated or transmitted to the fluid 48, where the fluid 48 is readily shaken by the proportion of the part of the vibrations transmitted thereto, so that such proportion is thereby dissipated in the fluid 48.

Those skilled in the art would appreciate that a number of alternative arrangements regarding the cavities in the inserts are possible. For example, instead of the engagement elements being positioned adjacent to cavities, the insert may comprise engagement elements positioned adjacent to pockets of softer or less rigid material, corresponding to the cavities. In this embodiment, the pockets of softer material would serve the function of dissipating, to an extent, the part of the vibrations transmitted or propagated to them.

In another alternative embodiment, the cavities preferably are not open to the atmosphere, but instead are sealed off from the atmosphere, and include one or more fluids therein selected for dissipating such part of the vibrations as are transmitted thereto.

For example, in one embodiment, the softer material in the pockets preferably is a suitable foam rubber, i.e., a natural latex or polyurethane having small, generally closed cells therein due to its processing, as is known. Alternatively, a suitable plastic foam (e.g., urethane foam) may be used. The foam material would have the advantage that, because its cells are closed, water cannot enter into the cells.

Those skilled in the art would appreciate that the rail assembly 20 may include a variety of other elements, e.g., connecting elements, that are not specifically described herein because they are well known in the art. In addition, it will be understood that, in practice, two rail assemblies preferably are positioned parallel to each other, and spaced apart a predetermined distance.

Those skilled in the art would also appreciate that the rail body 22 may, in fact, include a number of rails positioned end-to-end, and/or a single, unitary rail body. For example, the unitary rail may be formed by welding a number of rails together end-to-end (e.g., continuous welded rail).

Figure 4A:
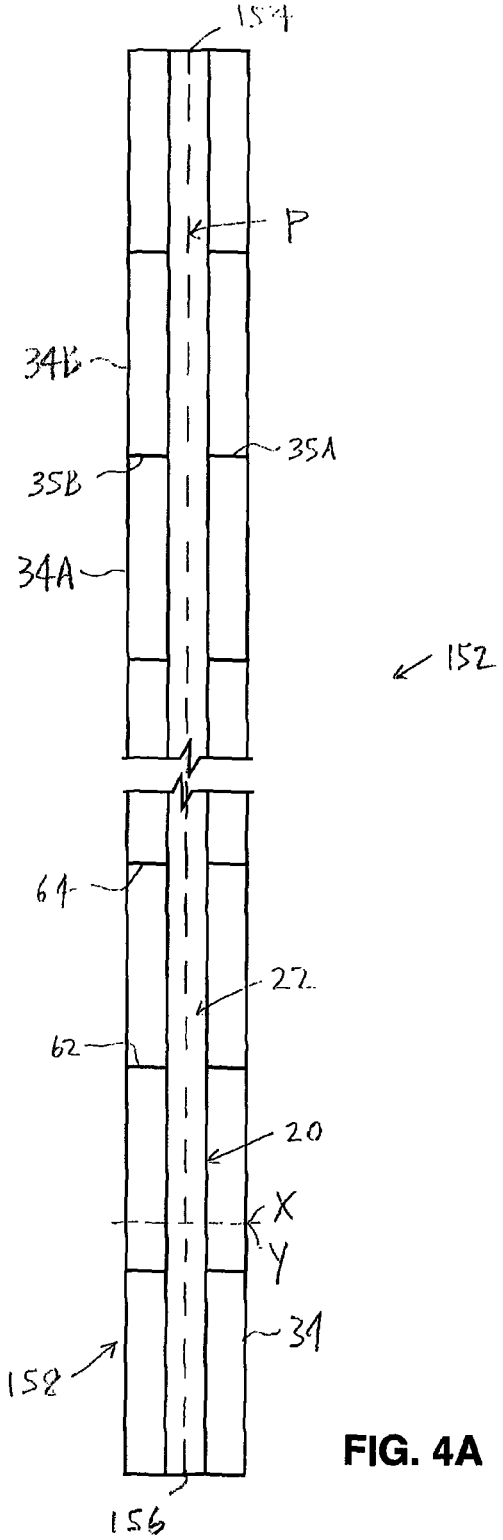
FIG. 4A is a schematic illustration of an embodiment of a rail system of the invention, drawn at a smaller scale.

In another embodiment, the invention preferably includes a rail system 152 that includes one or more rail assemblies 20 extending along a predetermined path "P" between a first end 154 and a second end 156 thereof (FIG. 4A). It will be understood that the predetermined path "P" is illustrated in FIG. 4A as being substantially straight for convenience. Those skilled in the art would appreciate that the predetermined path "P" may follow any suitable route, as is necessary or desirable according to the requirements of topography and geography. The rail assembly 20 preferably includes one or more rail bodies 22, as described above.

The rail body 22 preferably is formed for supporting rolling engagement of the train wheel 32 thereover, such rolling engagement generating vibrations in the rail body 22, as also described above. The rail system 152 preferably also includes one or more boot assemblies 158 attached to the rail body 22 and also extending substantially along the predetermined path "P", for substantially electrically isolating the rail body 22 relative to the ground material 21. As can be seen in FIG. 4A, it is preferred that the boot assembly 158 includes a number of the boots 34 attached respectively in series to the rail body 22, as will be described. Preferably, each boot 34 includes the foot portion 36 at least partially engaged with the foot 28 (e.g., as shown in FIG. 2B). Each foot portion 36 also preferably includes the chamber wall 38 of each boot 34 respectively to at least partially define the chamber 40 between the foot 28 and the chamber wall 38, providing a number of respective chambers located along the predetermined path "P".

It is also preferred that the rail system 152 includes a number of inserts 42 positioned in the respective chambers 40 located along the predetermined path "P", each insert 42 being engaged with the foot 28 for transmission to each insert 42 respectively of at least part of the vibrations, as described above. As will be described, each insert 42 preferably is configured for dissipation of a characteristic proportion of the part of the vibrations transmitted thereto. Preferably, each insert 42 is selected for a predetermined location along the predetermined path "P" respectively based on the characteristic proportion of said part of the vibrations dissipatable by each insert 42 respectively, as will also be described.

For the purposes hereof, "in series" is understood to mean "end-to-end", or substantially end-to-end. (In practice, there may be some overlap at the ends.) In FIG. 4A, for clarity of illustration, two of the boots that are positioned in series relative to each other are identified as 34A and 34B respectively. (It will be understood that a number of elements are omitted from FIG. 4A for clarity of illustration.) An end 35A of the boot 34A preferably is positioned to abut an end 35B of the boot identified in FIG. 4A as end 35B. As can be seen in FIG. 4A, the boots 34A and 34B are positioned end-to-end with respect to each other, i.e., they are positioned in series. It will be understood that, in the rail system 152, the boots 34 are positioned in series along the rail body 22, i.e., they are positioned along the predetermined path "P".

As noted above, in one embodiment, each insert 42 preferably is configured for dissipation of a characteristic proportion of the part of the vibrations transmitted or propagated thereto. As can be seen in FIGS. 3A-3E, the inserts may be formed to have a variety of suitable designs. The designs are intended to dissipate the proportion of the part of the vibrations transmitted to the fluid in the cavities, to varying extents respectively. Those skilled in the art would be aware that a number of factors (in particular, cost) may be taken into account in the design of the insert. For clarity of illustration, the inserts are identified in FIGS. 3A-3E as 42A-42E respectively. It will be understood that the versions 42A-42E of the insert illustrated in FIGS. 3A-3E are exemplary only. Those skilled in the art would also appreciate that the different inserts 42A-42E would each dissipate a characteristic proportion respectively of the part of the vibrations transmitted thereto. For example, the extent of the proportion of the part of the vibrations transmitted to the inserts 42A (FIG. 3A) and 42B (FIG. 3B) respectively differ, i.e., each of the inserts 42A, 42B dissipates a characteristic proportion thereof respectively.

Because of the numerous chambers 40 provided in the rail system 152 by the boots 34 that are secured to the rail body 22 in series along the predetermined path "P", this presents an opportunity to provide improved protection against vibrations in the ground material at selected locations along the predetermined path "P", i.e., along the rail body 22. Conversely, relatively less protection against vibration may be provided in other selected locations, i.e., where having relatively less protection is acceptable. In this way, the rail system 152 permits the achievement of optimal vibration isolation.

As noted above, in practice, the predetermined path "P" may, in part, be located in the vicinity of a facility (e.g., a hospital, or a school) near which vibrations from the rail system preferably should be minimized. In these cases, inserts designed to dissipate a greater proportion of the vibrations preferably are used at locations in the vicinity of the facility. It is anticipated that the inserts that tend to have a greater effect (i.e., those with a relatively higher characteristic proportion of the transmitted vibrations) would, in general, cost more than the less effective inserts. However, along most of the predetermined path "P", it is preferred that lower-cost inserts are used, i.e., the inserts that dissipate a relatively smaller proportion of the vibrations, to minimize costs.

Alternatively, or in addition, in those segments of the predetermined path "P" where relatively less attenuation of vibrations is acceptable, the conventional boot or jacket may be used, i.e., without an insert. This would also result in lower costs.

Figure 4B:
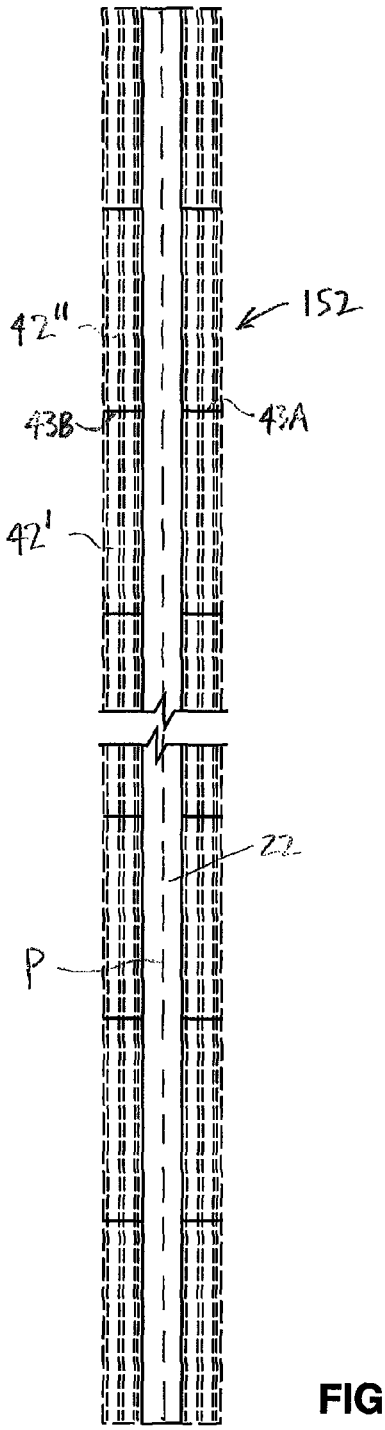
FIG. 4B is another schematic illustration of the rail system of FIG. 4A.

In FIG. 4B, the rail body 22 is shown, as well as the inserts 42. (It will be understood that a number of elements are omitted from FIG. 4B for clarity of illustration.) It will be understood that the inserts 42 are also positioned in series in the rail system 152, in the respective boots 34 that are also positioned in series relative to each other as described above. For clarity of illustration, two of the inserts are identified as 42' and 42" respectively. As can be seen in FIG. 4B, an end 43A of the insert 42' preferably abuts an end 43B of the insert 42".

As described above, in one embodiment, the rail assembly 152 preferably includes a number of the inserts 42 that have been selectively positioned inside preselected chambers 40 along the predetermined path "P", to locate the inserts according to the respective characteristic proportion of the part of the vibrations dissipated thereby. For instance, if a part of the predetermined path "P" is located near a hospital or a school, then the inserts installed in the rail assembly along that part preferably are configured to for dissipating a relatively high proportion of the part of the vibrations transmitted thereto.

In one embodiment, the insert 42 preferably includes an elongate base 59 extending between first and second base ends 60, 61 thereof (FIG. 1). The engagement element(s) 44 preferably are included in the base 59. It is also preferred that the cavities 46 are included in the base 59. Preferably, the cavities 46 are positioned between the engagement elements 44. As described above, each of the cavities 46 has one or more fluids 48 therein for dissipating the proportion of the part of the vibrations transmitted or propagated thereto.

In one embodiment of the rail boot system, each boot preferably is made of a first material formulated for extrusion thereof, and each base preferably is made of a second material formulated for at least partial dissipation of the proportion of the part of the vibrations transmitted thereto.

It will be understood that the effectiveness of any particular insert in dissipating vibrations may depend upon a number of factors. For instance, the effectiveness of the insert may be related to the proportion of its cross-sectional area that includes the cavities 46. In one embodiment, the chamber 40 preferably extends between first and second chamber ends 62, 64 (FIG. 4A), and the chamber 40 defines a first cross-sectional area (FIG. 2A) taken at a preselected first point "X" between the first and second chamber ends 62, 64. It is also preferred that the base 59 includes a second cross-sectional area thereof taken at a preselected second point "Y" between the first and second base ends 60, 61. Preferably, and as illustrated in FIG. 4A, the second point "Y" is substantially coincident with the first preselected point "X". As can be seen, for instance, in FIG. 2B, the second cross-sectional area preferably is less than the first cross-sectional area, and the difference between the first and second cross-sectional areas preferably is occupied by the cavities 46.

As can be seen in FIG. 2B, in one embodiment, the cavities 46 collectively comprise a volume that includes a predetermined proportion of a chamber volume defined by the chamber, for dissipation of the proportion of the part of the vibrations.

In one embodiment, the cavities and the engagement elements preferably are substantially consistent throughout the base, i.e., between the first and second base ends 60, 61. In such embodiment, it is believed that the volume of the cavities preferably amounts to between approximately 25% and approximately 50% of the total volume of the insert.

As described above, when the insert 42 is positioned in the chamber, the base 59 preferably is at least partially engaged with the foot 28, for transmission of the part of the vibrations to the base 59. It will be understood that the engagement element(s) 44 preferably are included in the base 59.

As can be seen in FIGS. 3A-3E, the cavities 46 may be defined within the base 59, or they may be otherwise partially defined by the base 59. For example, in FIG. 3A, the insert 42A preferably includes cavities 46A within the base 59A. In one embodiment, the cavities 46A preferably are open at the ends of the base 59A, i.e., in fluid communication with the atmosphere.

Figure 3A:
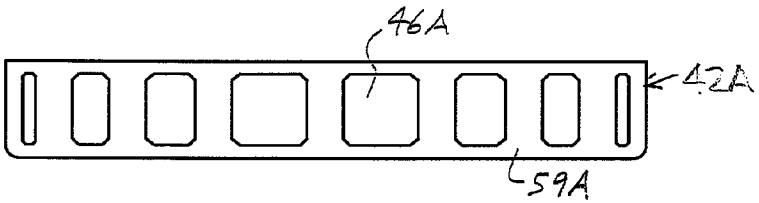
FIG. 3A is an elevation view of an embodiment of an insert of the rail assembly of the invention, drawn at a smaller scale.
Figure 3B:
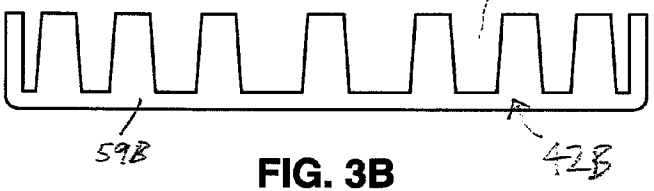
FIG. 3B is an elevation view of another embodiment of the insert of the rail assembly of the invention.
Figure 3D:
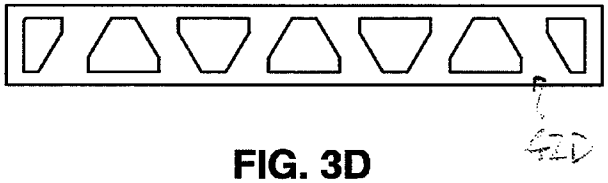
FIG. 3D is an elevation view of another embodiment of the insert of the rail assembly of the invention.
Figure 3C:
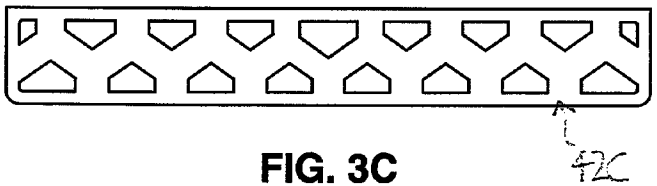
FIG. 3C is an elevation view of another embodiment of the insert of the rail assembly of the invention.
Figure 3E:
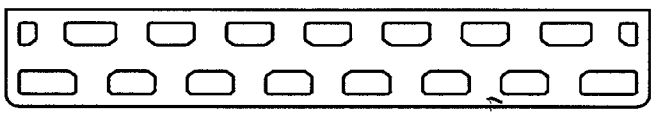
FIG. 3E is an elevation view of another embodiment of the insert of the rail assembly of the invention.

As another example, in FIG. 3B, the base 59B preferably includes a number of cavities 46B. The cavities 46B are only partially defined by the base 59B. It will be understood that, when the insert 42B is positioned in the chamber 40, the foot 28 also partially defines the cavities 46B.

Figure 5:
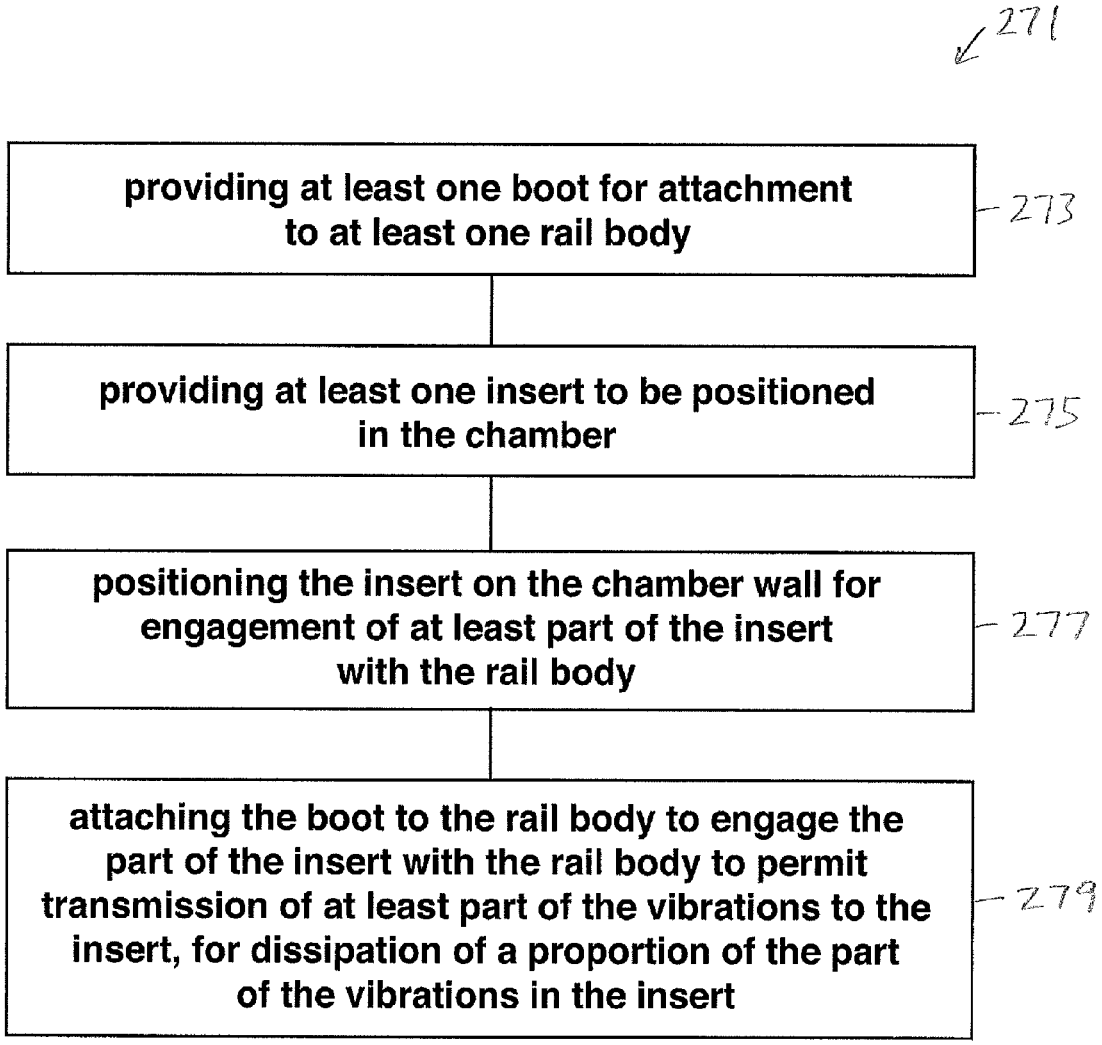
FIG. 5 is a flow chart schematically illustrating an embodiment of a method of the invention.

In use, an embodiment of a method 271 of the invention is for at least partially attenuating transmission of vibrations of the rail body 22 to the ground material 21. The ground material 21 is in the vicinity of the rail body 22, and may (directly or indirectly) support the rail body 22. Preferably, the method 271 includes the step of, first, providing the boot 34 for attachment to the rail body 22. The boot preferably includes the first material, formulated for extrusion thereof, as described above (FIG. 5, step 273). The insert 42 is provided, to be positioned in the chamber 40. The insert preferably includes a second material that is formulated for at least partial dissipation of the vibrations transmitted thereto, also as described above (step 275). Preferably, the insert 42 is positioned on the chamber wall 38, for engagement of at least part of the insert 42 with the rail body 22 (step 277). The boot 34 is attached to the rail body 22 to engage the part of the insert 42 with the rail body 22 to permit transmission of at least part of the vibrations to the insert, for dissipation of the proportion of the part of the vibrations in the insert 42 (step 279).

Figure 6:
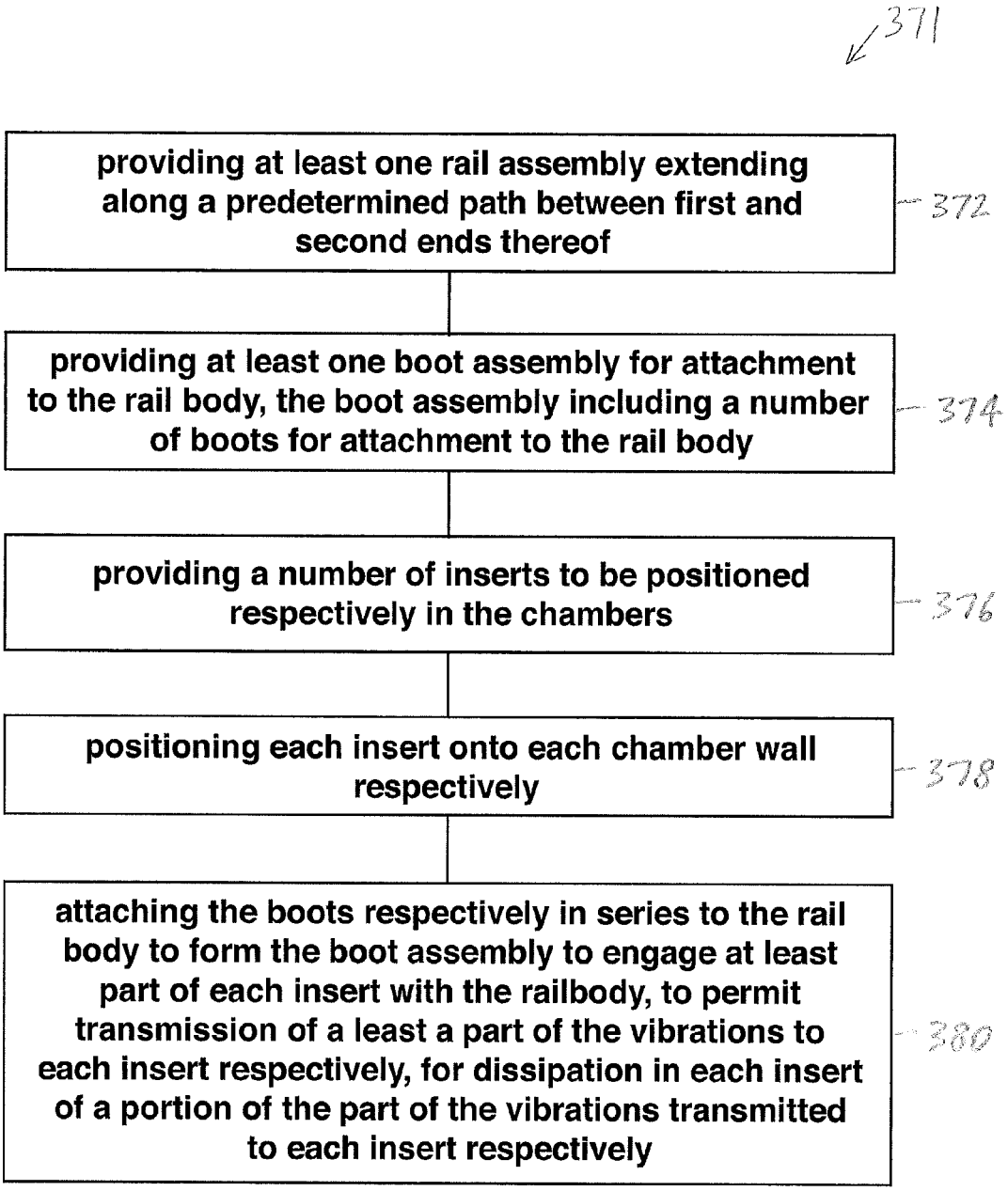
FIG. 6 is a flow chart schematically illustrating another embodiment of the method of the invention.

An alternative embodiment of the method 371 of the invention is schematically illustrated in FIG. 6. The method 371 is for at least partially attenuating transmission of vibrations of the rail body 22 to the ground material 21 at least partially supporting the rail body 22. Preferably, the method includes, first, providing the rail assembly 20 extending along the predetermined path "P" between the first and the second ends thereof including the rail body 22 (FIG. 6, step 372). The boot assembly 158 preferably is provided for attachment to the rail body 22, the boot assembly 158 including a number of boots 34 for attachment to the rail body 22 (step 374). A number of inserts 42 are provided, to be positioned respectively in the chambers 40 (step 376). Each insert 42 preferably is positioned onto each chamber wall 38 respectively (step 378). The boots 34 preferably are attached respectively in series to the rail body 22 to form the boot assembly 158. At least part of each insert preferably is engaged with the rail body 22, to permit transmission of at least part of the vibrations to each insert respectively, for dissipation in each insert respectively of the proportion of the part of the vibrations transmitted to each insert respectively (step 380).

It will be appreciated by those skilled in the art that the invention can take many forms, and that such forms are within the scope of the invention as claimed. The scope of the claims should not limited by the preferred versions set forth in the examples, but should be given the broadest interpretation consistent with the description as a whole.

I claim:

1. A rail assembly comprising:

at least one rail body at least partially supportable by ground material, said at least one rail body being formed for supporting rolling engagement of a train wheel thereover, said rolling engagement generating vibrations in said at least one rail body;

at least one boot formed for attachment with said at least one rail body to substantially electrically isolate said at least one rail body relative to the ground material, said at least one boot comprising a foot portion at least partially engageable with said at least one rail body when said at least one boot is attached to said at least one rail body, the foot portion comprising a chamber wall to at least partially define a chamber between said at least one rail body and the chamber wall;

a plurality of inserts positionable in the chamber, at least one insert comprising:

a volume of air positioned in at least one cavity in said at least one insert;

at least one engagement element formed for engagement with said at least one rail body for transmission of a part of the vibrations to said volume of air, in which at least a proportion of said part of the vibrations are dissipatable;

wherein the proportion of the part of the vibrations dissipated differs among the plurality of inserts;

said at least one boot comprising a thermoplastic vulcanizate; and said at least one engagement element comprising a material that is formulated for at least partial dissipation of the part of the vibrations transmitted thereto and selected from the group consisting of natural rubber, synthetic rubber, and polyurethane.

2. A rail system comprising:

at least one rail assembly extending along a predetermined path between a first end and a second end thereof, said at least one rail assembly comprising at least one rail body, said at least one rail body being formed for supporting rolling engagement of a train wheel thereover, said rolling engagement generating vibrations in said at least one rail body;

at least one boot assembly attached to said at least one rail body and extending along the predetermined path, for substantially electrically isolating said at least one rail body relative to ground material, said at least one boot assembly comprising a plurality of boots attached respectively in series to said at least one rail body, each said boot comprising a foot portion at least partially engaged with said at least one rail body, each said foot portion comprising a chamber wall of each said boot respectively to at least partially define a chamber between said at least one rail body and the chamber wall, providing a plurality of respective chambers located along the predetermined path;

a plurality of inserts positioned in the respective chambers located along the predetermined path, each said insert being engaged with said at least one rail body for transmission to each said insert respectively of at least part of the vibrations, each said insert being configured for dissipation of a characteristic proportion of the part of the vibrations transmitted thereto, wherein the characteristic proportion of the part of the vibrations dissipated differs among the plurality of inserts; and each said insert being selected for a predetermined location along the predetermined path respectively based on the characteristic proportion of said part of the vibrations dissipatable by each said insert respectively.

3. A rail system according to claim 2 in which each said insert comprises at least one engagement element that engages said at least one rail body to permit transmission of said part of the vibrations to said at least one engagement element.

4. A rail system according to claim 3 in which:

said at least one boot comprises a first material that is formulated for extrusion; and said at least one engagement element comprises a second material that is formulated for at least partial dissipation of the part of the vibrations transmitted thereto.

5. A rail system according to claim 4 in which:

the first material is thermoplastic vulcanizate; and the second material is selected from the group consisting of natural rubber, synthetic rubber, and polyurethane.

6. A rail system according to claim 3 in which each said insert additionally comprises at least one cavity having a volume of air therein engaged with said at least one engagement element, for transmission to said volume of air of said proportion of the part of the vibrations, and for at least partial dissipation of said proportion of said part of the vibrations in said volume of air.

7. A method of installing a rail system, comprising the steps of:

(a) providing a rail assembly positionable along a predetermined path, the rail assembly comprising at least one rail body at least partially supported by ground material, said at least one rail body being formed for supporting rolling engagement of a train wheel thereover, said rolling engagement generating vibrations in said at least one rail body;

(b) providing a boot assembly attachable to said at least one rail body and extending along the predetermined path, the boot assembly comprising a plurality of boots attached respectively to said at least one rail body in series, each said boot comprising a first material formulated for extrusion thereof, each said boot comprising a foot portion at least partially engageable with said at least one rail body, and each said foot portion comprising a chamber wall to at least partially define a chamber between said at least one rail body and the chamber wall to provide a plurality of chambers;

(c) providing a plurality of inserts positionable in the respective chambers, each said insert, when positioned in each said chamber respectively, being engageable with said at least one rail body for transmission to each said insert respectively of at least a part of the vibrations, each said insert being configured for dissipation of a characteristic proportion of the part of the vibrations transmitted thereto, each said insert comprising a second material formulated for at least partial dissipation of the characteristic proportion of the part of the vibrations transmitted thereto;

(d) selecting each said insert for installation in a preselected chamber respectively at a respective predetermined location along the predetermined path based on the characteristic proportion of said part of the vibrations dissipatable by each said insert respectively, wherein the characteristic proportion of said part of the vibrations dissipatable by a first one of said plurality of inserts differs from the characteristic proportion of said part of the vibrations dissipatable by a second one of said plurality of inserts;

(e) positioning each said insert on the chamber wall, to locate each said insert at the predetermined location for which each said insert is selected respectively; and (f) attaching said boots in series to said at least one rail body, to engage the foot portion of each said boot with said at least one rail body and to secure each said engagement element to said at least one rail body.

8. A rail boot system for covering a portion of at least one rail body for supporting a train wheel, the train wheel generating vibrations in said at least one rail body as the train wheel rolls thereover, said at least one rail body being at least partially supported by ground material, said at least one rail body extending along a predetermined path, the rail boot system comprising:

a boot assembly comprising a plurality of boots attached respectively in series to said at least one rail body, each said boot comprising a foot portion formed to at least partially define a chamber adjacent to said at least one rail body;

a plurality of inserts positionable in the chambers respectively for engagement of each said insert with said at least one rail body, for dissipation of at least a proportion of a part of the vibrations therein, each said insert comprising:

an elongate base extending between first base and second base ends thereof;

a plurality of cavities in the base, each said cavity having a volume of air therein for at least partially dissipating the proportion of the part of the vibrations in said volume of air;

each said boot comprising a thermoplastic vulcanizate;

each said base comprises a selected from the group consisting of natural rubber, synthetic rubber, and polyurethane;

the base comprising at least a preselected part thereof for engagement with said at least one rail body when the base is positioned in the chamber, for transmission of at least the part of the vibrations to the base;

each said insert being configured for dissipation of a characteristic proportion of the part of the vibrations transmitted thereto, wherein the characteristic proportion of the part of the vibrations dissipated differs among the plurality of inserts; and each said insert being selected for a predetermined location therefor respectively along the predetermined path based on the characteristic proportion of said part of the vibrations dissipatable by each said insert respectively.

9. A method of at least partially attenuating transmission of vibrations of at least one rail body to ground material at least partially supporting said at least one rail body, the method comprising the steps of:

(a) providing at least one rail assembly extending along a predetermined path comprising said at least one rail body;

(b) providing at least one boot assembly for attachment to said at least one rail body, said at least one boot assembly comprising a plurality of boots for attachment to said at least one rail body, each said boot comprising a chamber wall for at least partially defining a chamber between the chamber wall and said at least one rail body when each said boot is attached respectively to said at least one rail body;

(c) providing a plurality of inserts to be positioned respectively on the chamber walls;

(d) positioning each said insert onto each said chamber wall respectively;

(e) attaching the boots respectively in series to said at least one rail body to form said at least one boot assembly and to engage at least part of each said insert with said at least one rail body, to permit transmission of at least a part of the vibrations to each said insert respectively, for at least partial dissipation in each said insert of a proportion of the part of the vibrations transmitted to each said insert respectively; and (f) selecting each said insert for positioning in a preselected chamber therefor based on a characteristic proportion of the part of the vibrations that is at least partially dissipated by each said selected insert respectively, wherein the characteristic proportion of the part of the vibrations that is at least partially dissipated by each of the plurality of inserts differs among the plurality of inserts.

* * * * *